United States Patent [19]

Scillieri et al.

[11] 4,121,220

[45] Oct. 17, 1978

[54] FLAT RADAR ANTENNA EMPLOYING CIRCULAR ARRAY OF SLOTTED WAVEGUIDES

[75] Inventors: Antoine Scillieri, Houilles; Alain Caillaud, St.-Germain-En-Laye, both of France

[73] Assignee: Electronique Marcel Dassault, Paris, France

[21] Appl. No.: 764,991

[22] Filed: Feb. 2, 1977

Related U.S. Application Data

[63] Continuation-in-part of Ser. No. 651,787, Jan. 23, 1976, abandoned.

[30] Foreign Application Priority Data

Jan. 31, 1975 [FR] France ..... 75 03132

[51] Int. Cl.[2] ..... H01Q 13/10

[52] U.S. Cl. ..... 343/768; 343/771

[58] Field of Search ..... 343/768, 770, 771, 854

[56] References Cited

U.S. PATENT DOCUMENTS

| | | | |
|---|---|---|---|
| 2,981,948 | 4/1961 | Kurtz | 343/771 |
| 3,691,563 | 9/1972 | Shelton | 343/771 |
| 3,711,858 | 1/1973 | Reeder | 343/771 |

*Primary Examiner*—Eli Lieberman

*Attorney, Agent, or Firm*—Karl F. Ross

[57] ABSTRACT

A flat radar antenna comprises a generally circular array of juxtaposed radiators constituted by slotted waveguides, the array being divided into four quadrants each composed of a multiplicity of groups of radiators. The radiator groups of the entire array are connected to a high-frequency transceiver via parallel paths of identical electrical length, consituted in one embodiment by cascaded couplers of magic-T type, whereby the bandwidth of the antenna equals that of each group so as to facilitate frequency scanning.

8 Claims, 7 Drawing Figures

FLAT RADAR ANTENNA EMPLOYING CIRCULAR ARRAY OF SLOTTED WAVEGUIDES

CROSS-REFERENCE TO RELATED APPLICATION

This is a continuation-in-part of our copending application Ser. No. 651,787 filed Jan. 23, 1976 and now abandoned.

FIELD OF THE INVENTION

Our present invention relates to a flat radar antenna comprising a planar array of radiators, this array being subdivided into four quadrants connected via high-frequency paths to a common transmit/receive unit.

BACKGROUND OF THE INVENTION

Upon cophasal energization of the radiators of the several quadrants of such an antenna during a transmission phase, echos reflected by a target offset from the axis of the array will give rise to phase differences in the outputs of the antenna quadrants during a reception phase from which the location of the target (in terms of azimuth and elevation) can be determined by addition and subtraction. By varying the operating frequency of the transmit/receive unit, and therefore the wavelength of the radiated energy, these parameters can be determined with great exactitude.

It is known to design the radiators of such antennas as waveguides provided with longitudinal slots whose center-to-center spacing or pitch equals half the natural wavelength $\lambda_{go}$ of the guide. For operating wavelengths deviating significantly from $\lambda_{go}$, the waves radiated from different slots are no longer in phase (or phase opposition) so that a substantially planar wavefront cannot be maintained. This problem is aggravated as the length of the radiators is increased to enhance the power of the antenna.

OBJECT OF THE INVENTION

The object of our present invention, therefore, is to provide an improved antenna structure for a radar system of the type described which can operate over a wide band of frequencies to determine azimuth and elevation of a target.

SUMMARY OF THE INVENTION

We realize this object, in accordance with our present invention, by forming each quadrant of the planar antenna array from a multiplicity of radiator groups linked with the associated transmit/receive unit by feed means forming paths of identical electrical lengths.

With the radiators formed as slotted waveguides, as discussed above, the waveguides of each group advantageously extend parallel to one another and communicate with a common transverse guide forming part of the feed means. The transverse feed guides of all the radiator groups may be connected to the transmit/-receive unit by a cascade of hybrid couplers of the "magic-T" type and intervening waveguide sections. Alternatively, the transfer of outgoing or incoming wave energy between the transmit/receive unit and the radiators may take place via probes inserted into the radiating waveguides themselves or into their transverse feed guides.

BRIEF DESCRIPTION OF THE DRAWING

The above and other features of our invention will now be described in detail with reference to the accompanying drawing in which.

SPECIFIC DESCRIPTION

Figure 1:
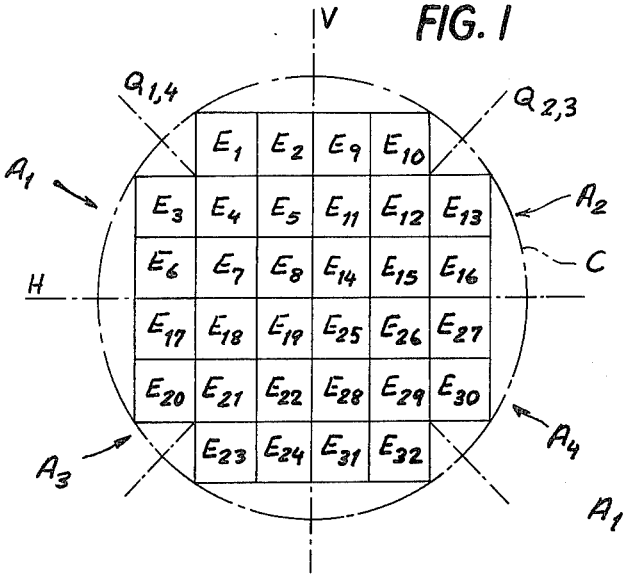
FIG. 1 is a diagrammatic plan view of a radar antenna embodying our invention.

In FIG. 1 we have shown a radar antenna of generally circular outline divided by a horizontal axis H and a vertical axis V into four identical quadrants $A_1 - A_4$. It will be understood that the terms "horizontal" and "vertical" applied to these axes refer only to the drawing and that in reality the entire antenna may lie in a horizontal or near-horizontal plane.

As further shown in FIG. 1, the antenna is divided into a multiplicity of square elemental components $E_1 - E_{32}$, each quadrant containing eight such components which are symmetrically positioned about a diagonal line $Q_{1,4}$ or $Q_{2,3}$ bisecting the quadrant. Each of these components represents a group (FIGS. 2 and 3) of parallel radiating waveguides G, namely five radiators per group in the specific embodiment described. On the front face $f_I$ of generic component E, FIG. 2, the several radiators G are each provided with a number of longitudinally oriented slots *r* arranged in two mutually staggered, transversely separated rows on opposite sides of a median longitudinal plane *m;* the center-to-center spacing between any slot in the upper row and the next-following slot in the lower row is $\lambda_{go}/2$ where $\lambda_{go}$ is the natural wavelength of any guide G as discussed above.

Figure 3:
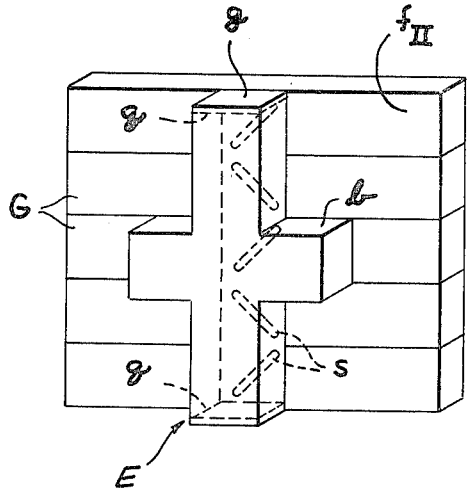
FIG. 3 is a perspective rear view of the radiator group shown in FIG. 2.

The rear face $f_{II}$ of component E, as shown in FIG. 3, carries a transverse feed guide *g* which has substantially the same natural frequency as the radiating guides G and is coupled therewith through respective oblique slots *s*. Waveguide *g* is shown centrally connected to a guide section *b* representing an extension of a lateral branch of a magic-T coupler as more fully described hereinafter with reference to FIGS. 4 and 6. In principle, the connecting guide *b* could join the feed guide *g* also at one of its ends; with the central connection shown, however, the small phase shift occurring among the several radiating guides G upon a deviation from the normal operating wavelength $\lambda_{go}$ is further reduced. In this instance the ends of feed guide *g* are advantageously closed by short-circuit terminations *q* whereby the feed guides of vertically adjoining groups are electrically separated from one another. Such electrical separation exists also between feed guides connected to opposite lateral branches of a common magic-T coupler.

Since quadrant $A_1$ is representative of all the quadrants of the antenna shown in FIG. 1, only the radiator groups $E_1 - E_8$ will be specifically referred to hereinafter. The feed guides of these radiator groups, specifically designated $g_1 - g_8$, have been shown in FIGS. 4 and 6 in the same relative position which they occupied in the array of FIG. 1.

Figure 4:
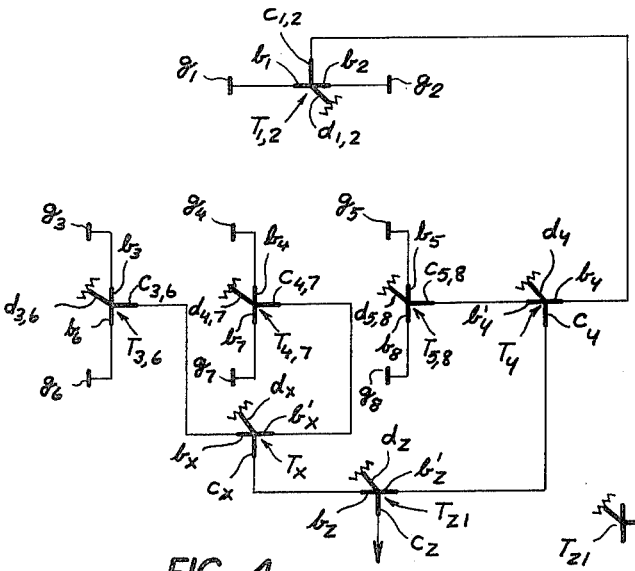
FIG. 4 is a schematic view of the layout of a feed circuit of a set of radiator groups arrayed in a quadrant of the antenna of FIG. 1.

As particularly illustrated in FIG. 4, these feed guides are connected in pairs to respective branches of four magic-T couplers $T_{1,2}$, $T_{3,6}$, $T_{4,7}$ and $T_{5,8}$. Coupler $T_{1,2}$ has lateral branches $b_1$, $b_2$, a summing or H-plane arm $c_{1,2}$ and a differential or E-plane arm $d_{1,2}$, the latter being terminated in a matching impedance. In an analogous manner, coupler $T_{3,6}$ has lateral branches $b_3$, $b_6$, a summing arm $c_{3,6}$ and a terminated differential arm $d_{3,6}$; coupler $T_{4,7}$ has lateral branches $b_4$, $b_7$, a summing arm $c_{4,7}$ and a terminated differential arm $d_{4,7}$; and coupler $T_{5,8}$ has lateral branches $b_5$, $b_8$, a summing arm $c_{5,8}$ and a terminated differential arm $d_{5,8}$.

Summing arms $c_{3,6}$ and $c_{4,7}$ are connected to respective lateral branches $b_x$, $b'_x$ of a coupler $T_x$ also having a summing arm $c_x$ and a terminated differential arm $d_x$. Similarly, the summing arms $c_{1,2}$ and $c_{5,8}$ are connected to lateral branches $b_y$ and $b'_y$ of a coupler $T_y$ having a summing arm $c_y$ and a terminated differential arm $d_y$. Arms $c_x$ and $c_y$ of these latter couplers are extensions of lateral branches $b_z$ and $b'_z$ of a further coupler $T_{z1}$ having a summing arm $c_z$ and a terminated differential arm $d_z$.

Figure 5:
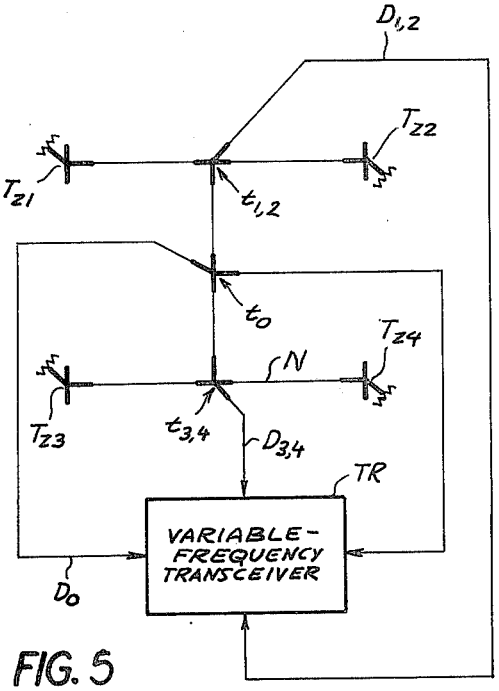
FIG. 5 diagrammatically shows connections between a transmit/receive unit and the feed circuits of the four antenna quadrants.

As shown in FIG. 5, coupler $T_{z1}$ of quadrant $A_1$ and corresponding couplers $T_{z2}$, $T_{z3}$ and $T_{z4}$ of the remaining quadrants have their summing arms tied to respective branches of another pair of couplers $t_{1,2}$ and $t_{3,4}$ whose summing arms are extensions of the lateral branches of a central coupler $t_0$. A variable-frequency transceiver TR has an input/output waveguide N connected to the summing arm of coupler $t_0$ and is linked with the differential arms of couplers $t_0$, $t_{1,2}$ and $t_{3,4}$ by way of respective connecting guides $D_0$, $D_{1,2}$ and $D_{3,4}$. Transmit/-receive unit TR includes conventional circuitry for evaluating, during a receiving phase, the signals arriving via waveguides N, $D_0$, $D_{1,2}$ and $D_{3,4}$ in order to determine the position of a target reflecting energy radiated by the antenna of FIG. 1 during a transmission phase in which the several antenna components $E_1 - E_{32}$ are cophasally excited by way of guide N.

Figure 6:
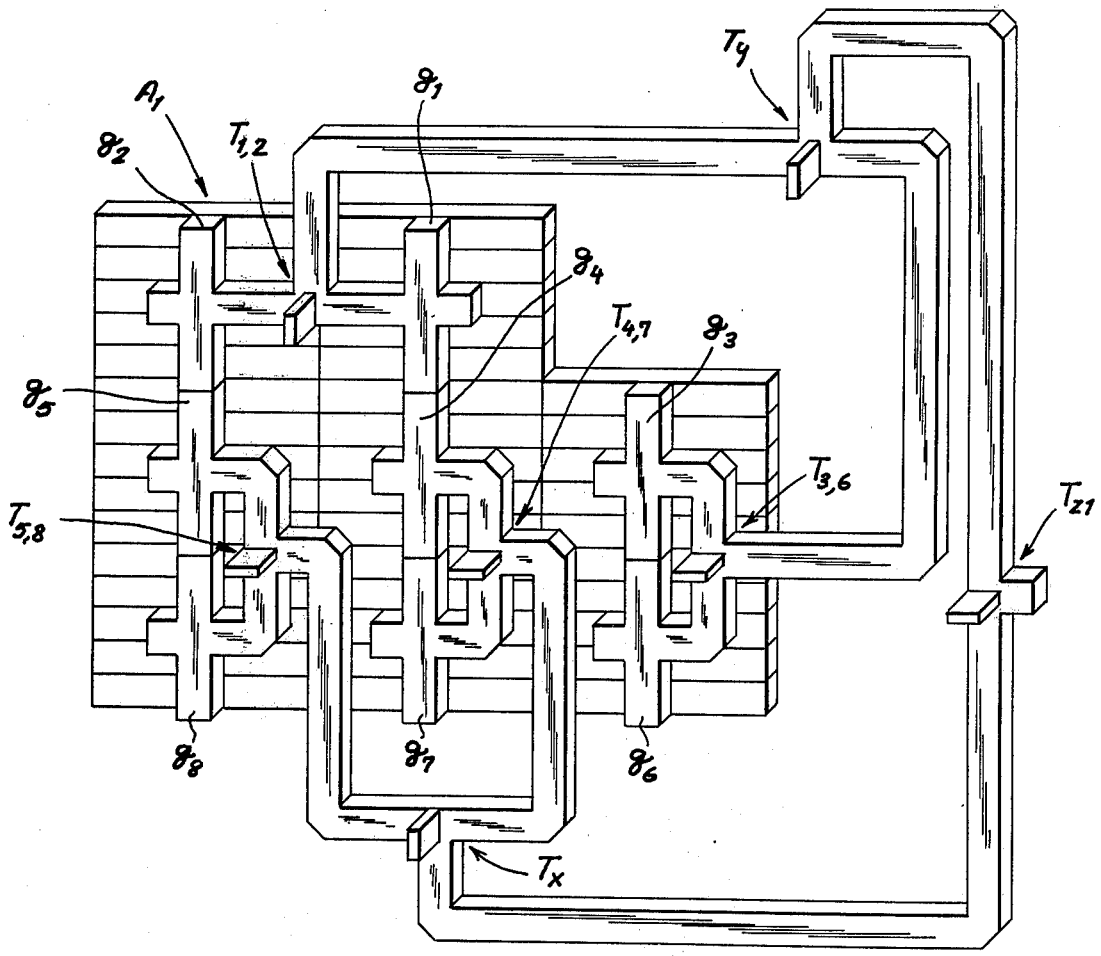
FIG. 6 is a perspective diagram showing the structure of the circuit elements of FIG. 4.

In order to insure such cophasal excitation regardless of frequency, the signal paths extending from the source TR to the various feed guides $g$ should be of the same electrical length which in the case of identically constructed waveguides translates into the same physical length. This is illustrated in FIG. 6 which shows the actual connections between coupler $T_{z1}$, common to all the radiators of quadrant $A_1$, and the several feed guides $g_1 - g_8$ of that quadrant. Since each component $E_1 - E_8$ encompasses only a small fraction of the entire quadrantal area, the excitation of all individual radiators G is approximately in phase for any frequency.

Figure 7:
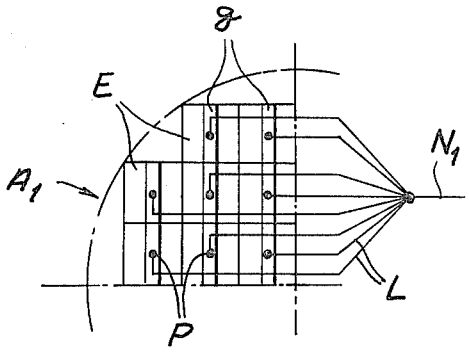
FIG. 7 diagrammatically shows an alternate feed circuit for one of the antenna quadrants.
Figure 2:
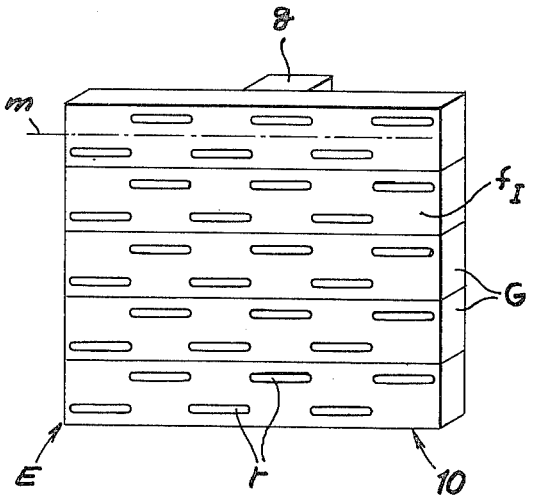
FIG. 2 is a perspective front view of a radiator group forming a component of the antenna structure shown in FIG. 1.

In FIG. 7 we have shown an alternate feed circuit in which probes P of the several waveguides $g$ of a quadrant are separately connected by a set of lines L to a common junction element in the form of a conductor $N_1$ assigned to quadrant $A_1$. In a manner analogous to that described with reference to FIG. 5, conductor $N_1$ and its counterparts assigned to the remaining quadrants are cophasally energized during a transmission phase from unit TR and deliver incoming signals to summing and differential inputs of that unit during a receiving phase. Again, cophasal excitation is insured by making all the leads L of the same electrical and physical length. Instead of going to the respective feed guides $g$ as shown, these leads could also have branches terminating in individual probes within each associated radiating guide G (FIGS. 2 and 3). Conductor $N_1$, like the quadrantal junction elements constituted by couplers $T_{z1}$ etc., serves for the additive reception of wave energy picked up by the associated radiator groups.

In a practical realization, the diameter of the antenna array shown in FIG. 1 was $30\lambda_{go}$. The useful band of operating frequencies had a width of $0.12\lambda_{go}$, compared with a maximum width of $0.02\lambda_{go}$ available in conventional antenna structures of the same general type. This corresponds to a sixfold increase in the bandwidth of the system.

We claim:

1. In a radar system including a transmit/receive unit of high-frequency waves, the combination therewith of an antenna comprising a planar array of juxtaposed radiators in the form of mutually parallel slotted waveguides, said array being divided into four quadrants each composed of a multiplicity of substantially square radiator groups, and feed means forming paths of identical electrical lengths extending from said unit to all the radiator groups of each quadrant, the radiator groups of each quadrant being arrayed symmetrically about a quadrantal bisector.

2. The combination defined in claim 1 wherein the number of radiator groups in each quadrant is eight.

3. In a radar system including a transmit/receive unit of high-frequency waves, the combination therewith of an antenna comprising a planar array of juxtaposed radiators in the form of mutually parallel slotted waveguides, said array being divided into four quadrants each composed of a multiplicity of radiator groups each provided with an individual transverse feed guide common to all the waveguides thereof, and circuit means connecting the feed guides of the several radiator groups of each quadrant over partly separate paths to said unit.

4. The combination defined in claim 3 wherein said circuit means includes an individual junction element for each quadrant linked to the feed guides thereof for additive reception of wave energy picked up by the associated radiator groups.

5. The combination defined in claim 4 wherein said junction element is a magic-T coupler with a pair of lateral arms linked to the feed guides of the respective quadrant through further magic-T couplers in cascade therewith.

6. The combination defined in claim 3 wherein each feed guide has opposite ends provided with short-circuit terminations.

7. The combination defined in claim 3 wherein the paths connecting the feed guides of all quadrants to said unit are of the same electrical length.

8. The combination defined in claim 3 wherein said array has a generally circular outline, each of said radiator groups being substantially square.

* * * * *